US006994291B2

(12) United States Patent
Kemp et al.

(10) Patent No.: US 6,994,291 B2
(45) Date of Patent: Feb. 7, 2006

(54) END-BOARD FOR A CORE-WOUND ROLL PRODUCT PACKAGING SYSTEM

(75) Inventors: Sharon J. Kemp, Mendon, NY (US); Cheryl L. Wetmore, Fairport, NY (US)

(73) Assignee: ExxonMobil Oil Corporation, Irving, TX (US)

( * ) Notice: Subject to any disclaimer, the term of this patent is extended or adjusted under 35 U.S.C. 154(b) by 0 days.

(21) Appl. No.: 10/745,351

(22) Filed: Dec. 22, 2003

(65) Prior Publication Data

US 2005/0133659 A1 Jun. 23, 2005

(51) Int. Cl.
*B65H 75/18* (2006.01)

(52) U.S. Cl. ..... 242/588.6

(58) Field of Classification Search ..... 242/588.3, 242/588.6; 206/389, 397, 398, 399, 402, 206/403, 407, 413–416, 386, 598, 595
See application file for complete search history.

(56) References Cited

U.S. PATENT DOCUMENTS

| | | | | | |
|---|---|---|---|---|---|
| 3,472,364 | A | * | 10/1969 | Sloan | 206/397 |
| 3,756,392 | A | * | 9/1973 | Oehlmann | 206/407 |
| 4,732,271 | A | * | 3/1988 | Solyntjes | 206/416 |
| 4,877,133 | A | | 10/1989 | Klenter et al. | |
| 4,884,690 | A | | 12/1989 | Klenter et al. | |
| 4,928,827 | A | * | 5/1990 | Hara | 206/413 |
| 5,205,411 | A | | 4/1993 | Born et al. | |
| 5,287,816 | A | | 2/1994 | Jungpeter et al. | |
| 5,344,013 | A | * | 9/1994 | Born et al. | 206/416 |
| 5,415,289 | A | | 5/1995 | Kim | |
| 5,431,282 | A | * | 7/1995 | Kremp et al. | 206/413 |
| 5,542,534 | A | * | 8/1996 | Dinter et al. | 206/416 |
| 5,620,093 | A | | 4/1997 | Born | |
| 6,073,768 | A | | 6/2000 | McCord et al. | |
| 6,193,695 | B1 | | 2/2001 | Rippstein, Jr. | |
| 6,315,122 | B1 | | 11/2001 | McCord et al. | |
| 6,458,105 | B1 | | 10/2002 | Rippstein, Jr. et al. | |

FOREIGN PATENT DOCUMENTS

| | | |
|---|---|---|
| DE | 29800427 | 4/1998 |
| JP | 201485 | 8/1993 |
| JP | 63-259658 | * 10/1998 |
| JP | 192081 | 7/2003 |

* cited by examiner

*Primary Examiner*—William A. Rivera
(74) *Attorney, Agent, or Firm*—Rick F. James

(57) ABSTRACT

An end-board for supporting and handling a core-wound roll of material, such as a roll of polymer film. The end-board includes a support plate having a product face, an outer face, a core support aperture, and a core channel, the core support aperture adapted to support a core plug or a core therein. The product face includes a roll recess for receiving an end of the core-wound roll within the roll recess when the core plug or core is positioned in the core support aperture. A locking collar may be used to selectively engage the support plate in the support plate core channel to prevent the supported core or core plug from passing through the core channel. A pair of handles within the support plate may be used to facilitate end-board manipulation.

26 Claims, 4 Drawing Sheets

END-BOARD FOR A CORE-WOUND ROLL PRODUCT PACKAGING SYSTEM

BACKGROUND OF THE INVENTION

The invention generally relates to an apparatus for supporting a roll of film or similar product wound onto a support core. More specifically, but without limitation, the invention relates to an apparatus and system to facilitate improved storage, manipulation, protection and transportation of the core-wound roll product, with particular applicability to rolls of polymeric film.

Manufacturing of polymer films typically creates a long, wide web of thin film, which is rolled onto a support core, resulting in a roll of film product. These core-wound rolls facilitate manipulation, storage, protection and shipping of the polymer films. Such rolls may contain in excess of ten thousand linear meters of polymer film and may exceed four meters in width, one meter in diameter, and may weigh more than fourteen hundred kilograms (over 3000 pounds). A master roll may be subsequently slit into two or more slit rolls, each having a width of from a few centimeters to in excess of two-and-one-half meters.

Elongate tubes or mandrels called cores, commonly formed of paperboard or metal and having a hollow through-bore, are typically used to support the film product wound thereon. It is desirable to re-use cores several times before discarding, as the rolls may be unwound and rewound several times during film processing and converting, with each unwinding and rewinding operation typically requiring use of an additional core. It is desirable to re-use cores several times before discarding. Cores are typically three to ten inches in diameter, with some cores designed to protrude a few inches beyond each end of the roll. To permit a roll to be supported in a variety of different devices, some cores terminate flush with the end of the wound product and an adapter or mandrel commonly referred to as a core plug having a proper diameter may be inserted partially into the core through-bore and protrude beyond the end of the wound product. Thereby, the core plug supports the roll.

Produced film rolls are subjected to significant manipulation, stacking for storage, transportation, moving through processing and converting facilities, loading onto machinery, and shipping to end users who impose still further handling to the rolls. Rolls are commonly manipulated by equipment including automated handling equipment, core manipulators, conveyors, forklifts, dollies, and sleds. Supporting and manipulating the core-wound film roll by the core protects the film roll and prevents damaging or contaminating the film product, as may occur if a film roll directly engages a floor, table or other unclean surface. It is desirable during such handling to support and protect the roll from impact or other contact damage and from contaminating materials or moisture.

To facilitate such manipulation and protection, rolls are typically supported by a pair of vertically erect "end-boards," each engaging and supporting an end of the core. The end-boards commonly are additionally supported by a variety of bracing, cross-members connecting both end-boards, wooden pallets, and/or crating. Wood and/ fiber-board, such as medium density fiberboard ("MDF") are commonly used materials for crating, packaging and for end-boards, including using screws and nail type fasteners to build and secure the packaging structure. The end-boards and bracing are commonly further supported upon and strapped to a wooden pallet with strapping materials. The crated, palleted and strapped roll may then be wrapped with plastic stretch-wrap to provide further structural support and protect the film product from contamination by dust, moisture and impact damage.

In addition to being costly, a significant drawback to such packaging arrangement is that each packaged roll requires significant unpacking and disassembly time, labor and cost to prepare the roll for use or further processing. Manipulation is bulky, requiring significant room to store and manipulate the crated packages. Empty, partially disassembled crating and end-boards are bulky, not easily collapsible, and costly to dispose or return for reuse. Frequently, the strapping and/or stacking causes damage to the end-boards, either shortening their life or rendering them non-reusable.

Another significant drawback to such packaging systems is that unpacking and uncrating is generally performed by manual labor requiring substantial disassembly of the packaging system.

In some packaging systems, this operation may require personnel to manually lift, remove, and manipulate each end-board. Wood end-boards, including MDF end-boards, for large diameter rolls can be quite heavy, weighing in excess of forty pounds. Lack of handles or manipulating means result in handling difficulties and costs. Related problems may arise as the end-boards are disengaged from rolls, sometimes resulting in a core falling unimpeded, damaging the end-board and potentially contaminating or damaging several layers of film.

Repositioning a core-wound roll at another location may require securing the end-boards to the roll, such as by strapping, or manually repositioning large and/or heavy end-boards at the destination for receiving the roll thereon. De-end-boarding and re-end-boarding operations to reposition rolls are time consuming, frequently labor-intensive and may require manually transporting, manipulating and positioning of such end-boards.

To address some of these issues, the prior art has developed a few polymeric end-boards. However, numerous functional and operational deficiencies remain. U.S. Pat. No. 6,315,122 discloses a polymeric end-board. End-boards according to the '122 patent have several disadvantages. First, the channel for receiving the core does not secure the end-boards to the core when the core-wound roll is lifted vertically. This necessitates manual replacement of the end-boards when the roll is lifted, moved and ready for deposit at another location lacking means for otherwise supporting the core.

For polymeric end-boards to avoid increasing the overall width of a supported roll assembly, each end-board would have to have the same thickness between the product face and the outer face as the wood end-boards. However, polymeric end-boards of such width may be insufficiently stable. Another significant disadvantage of polymeric end-boards according to the '122 patent is that these end-boards are at least twice as thick between the product face and outer face as wooden end-boards. This extra width is provided for lateral stability, but results in a wider stacked assembly. Further, a foot member extends at the base of the '122 patent end-board laterally toward the opposing end-board and engages a lateral support member beneath the foot feature to further improve lateral stability. The feet impart stability to end-boards only when they are engaged with a supporting surface, such as a floor, a pallet, or in the case of a stacked roll, when the feet on the upper end-boards engage a pair of lateral cross-members extending between two lower end-boards. Otherwise, the feet on the upper end-boards on a stacked end-board system engage nothing and are ineffective.

Such stacked assembly embodiment inherently possesses undesirable weight, assembly and disassembly time, including the use and storage of elongated lateral supports or cross-members.

To overcome the limitation of requiring the lateral cross-members and stabilizing feet, some prior art end-boards are merely provided with a larger thickness between the product face and the outer face to provide the desired amount of lateral stability. However, such enlargement frequently renders these end-boards non-reusable or inconvenient for use in existing roll handling and storage systems.

In addition to these functional limitations, the foot features of the '122 patent end-boards are also bulky, irregular-shaped, and require additional storage and transport consideration and space when empty, including inefficient stacking and special handling. Such obstacles are of significant concern when managing an inventory of several thousand end-boards. A foot feature also undesirably adds weight to each end-board, which is of concern not only for manual manipulation of individual end-boards, but in the aggregate for large inventories.

Another disadvantage of the '122 patent end-board is that there is no direct means for locking or engaging the end-boards onto the core when the core is lifted vertically. When lifted vertically, the core would merely slide vertically out of the end-board, through the vertical channel. Securing the core to the end-board requires special handling to provide a core plug for insertion into each end of the core, wherein the core plug has a cross-sectional diameter that is larger than the width of the vertical channel. Such arrangement undesirably creates additional steps for applying and for removing the end-boards, and maintaining an inventory of a variety of core-plug size combinations to facilitate mating a variety of core sizes with one or more end-board channel sizes.

U.S. Pat. No. 5,205,411, to Born, et al., offers an end-board that has several disadvantages. First, the '411 patent end-board does not provide a vertical channel to facilitate optionally removing the core and roll vertically from the end-boards. Attaching and removing the end-boards from the cores is limited to lateral movement, requiring manual manipulation, thus discouraging use of such end-boards in many automated roll-handling systems.

An advantage of polymeric end-boards is that the polymeric end-board can be significantly lighter weight than a comparable sized MDF or wooden end-board. However, to achieve this weight reduction, polymeric end-boards are commonly fabricated with a relatively wide lattice or web of support ribs, the width being perpendicular to the plane of the product face. The '411 patent end-boards are too wide between the product face and the outer face to facilitate "drop-in" replacement for MDF and wooden end-boards in many existing storage rack systems. In storage and transport systems where space is at a premium or with fixed storage bin sizes, unnecessarily wide end-boards are not useable.

There exists a need for an end-board that overcomes the aforementioned limitations and disadvantages of the known end-boards and roll product packaging systems. There further exists need for an end-board that improves roll packaging efficiency and accommodates a wide variety of roll manipulation and handling needs, including drop-in replacement for some existing systems utilizing MDF end-boards.

SUMMARY OF THE INVENTION

There is provided an end-board for supporting a core-wound roll product, the end-board comprising a vertically erect support plate and optionally a core locking collar for securing the vertical plate to the core. The support plate may comprise a top surface, a base surface, a first side and a second side, a product face, an outer face, a core support aperture, and a core channel connecting the core support aperture with the top surface. The top surface is discontinuous or containing a gap across the core channel. The core support aperture supports at least one of a core plug or a core therein. The product face of the support plate further comprises a roll recess for receiving an end of the core-wound role product within the roll recess when the core plug or the core is positioned in the core support aperture.

Optionally, a removable locking collar is also provided to selectively mechanically engage with the support plate in the support plate core channel to prevent the core plug or the core from passing vertically through the core channel when the locking collar is engaged with the support plate.

The provided end-board overcomes the aforementioned problems with the prior art end-boards, such as problems introduced by the prior art end-boards that possess a foot protrusion extending laterally beyond the plane of the product face and necessitating a lateral support member for stability. Further, this invention facilitates roll-packaging system improvements that were previously unavailable, such as having one end-board system with versatility that allows improved handling while simultaneously affording integration into automated systems requiring either or both of lateral core-to-end-board manipulation and/or vertical core-to-end-board manipulation. This invention permits "drop-in" replacement of prior art end-board systems without having to modify any existing roll storage, packaging or manipulation systems.

It is an object of this invention to provide an end-board useful as a drop-in replacement for MDF, wood, and prior art polymeric end-boards to facilitate use in handling systems that are size-critical or space-dependent.

It is a further object of this invention to provide an end-board that reduces the roll packaging assembly and disassembly effort, complexity, time and cost. End-boards according to this invention provide functional improvements including eliminating the requirement for lateral foot supports and support cross-members, and providing for a pair of non-protruding hand-holds integrated into the end-board support plate.

Still another object of this invention is to provide an end-board that can be easily and efficiently stacked, bulk stored, and reused several times.

It is a feature of this invention that the end-boards may be manufactured with polymeric material, offering substantially reduced weight while providing improved strength and durability as compared with MDF or wooden end-boards of like size and function.

Another feature of an end-board according to the present invention is that it is useable with and easily integrated into any of fully automated, semi-automated, and/or manual roll manipulation and handling systems, without requiring system or end-board modification. The end-boards can be readily integrated into a system having a variety of other end-board types, such that implementation can be done gradually or for only select customers if so desired.

It is a feature of end-boards according to the present invention that the end-boards can stand vertically on the base surface with lateral stability, whether supporting a core or absent the core, without requiring additional supporting members or feet.

It is yet another feature of the present invention that the end-board includes a U-shaped channel to permit a core or core plug to move vertically into and out of support engagement with the end-board.

An additional feature of this invention is the inclusion of a locking collar to selectively, mechanically engage the end-board to secure the core or core plug within the U-shaped channel. This feature prevents the end-board from disengaging from the core or core plug when the roll is vertically elevated and disengaged from support at the end-board base. Thereby, the roll may be manipulated or transported without removing and reinstalling the end-boards.

It is an advantage of this invention that the end-boards may be provided with cleats for engaging an adjacent, stacked wooden pallet. The end-board may also include a pattern of interlocking recesses and tabs along the top and base surfaces to stabilize the upper end-board in a stacked end-board and roll assembly. Additionally, the end-board may include notches along its perimeter to accommodate strapping if so desired.

It is also an advantage that the end-board may include a placard slot or display surface on an outer face for posting roll documentation. Additionally, when empty the end-boards nest to each other for ease of handling and transportation.

These and other objects, features, and advantages are illustrated and discussed in the following drawings and detailed description. The disadvantages of prior art are overcome by the present invention providing an improved end-board, including an improved system and method for supporting and handling core-wound roll products.

DETAILED DESCRIPTION OF THE INVENTION

Figure 1:
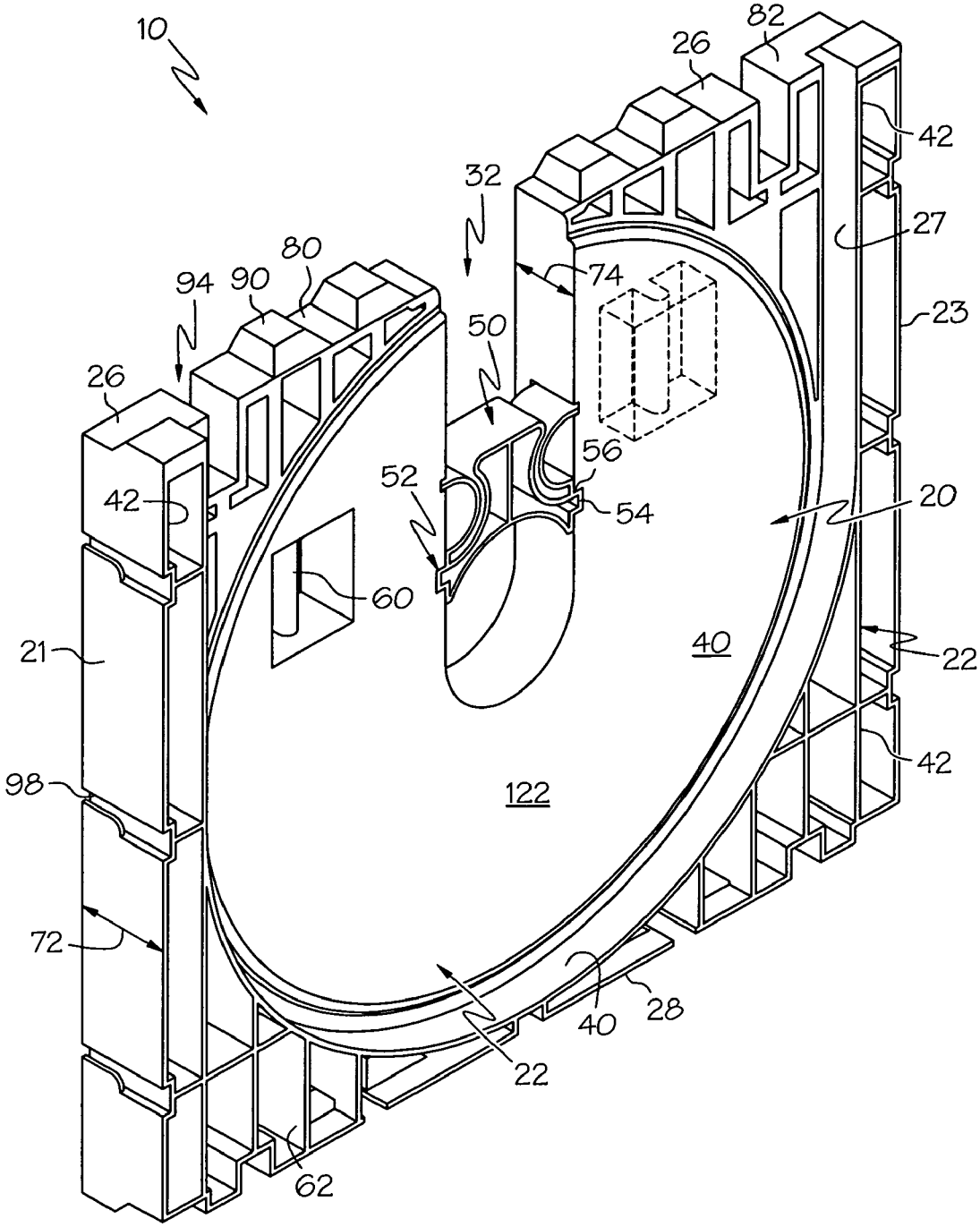
FIG. 1 is an orthogonal illustration of the product face, top surface and one side of an end-board according to the present invention.

End-boards according to the present invention provide unique functional features that overcome the limitations and undesirable properties of prior art end-boards. An end-board is provided that facilitates stacked lateral stability and free-standing lateral stability, without requiring laterally protruding foot members or additional cross-members for stabilizing the upper end-boards and roll in a stacked assembly. Further, end-boards according to this invention do not increase the overall width of a supported roll assembly as compared to prior art wooden end-boards. In addition to overcoming the deficiencies of prior art end-boards, the end-boards according to this invention also provide unique functional options.

The term "lateral" as used herein is defined to mean a direction substantially along the centerline or long axis of the core and including movement in a direction such as by a vertically erect end-board toppling over in an arc having a displacement component generally along the core long-axis centerline.

FIGS. 1, 2, 3 and 4 illustrate one or more preferred embodiments of an end-board 10 according to the present invention, comprising a support plate 20 and optionally, but preferably including a locking collar 50. The support plate 20 comprises a top surface 26, a base surface 28, a first side 21 and a second side 23, a product face 22, an outer face 24, a core support aperture 30, a core channel 32 connecting the core support aperture with the top surface 26, the top surface 26 being discontinuous across the core channel 32.

Figure 5:
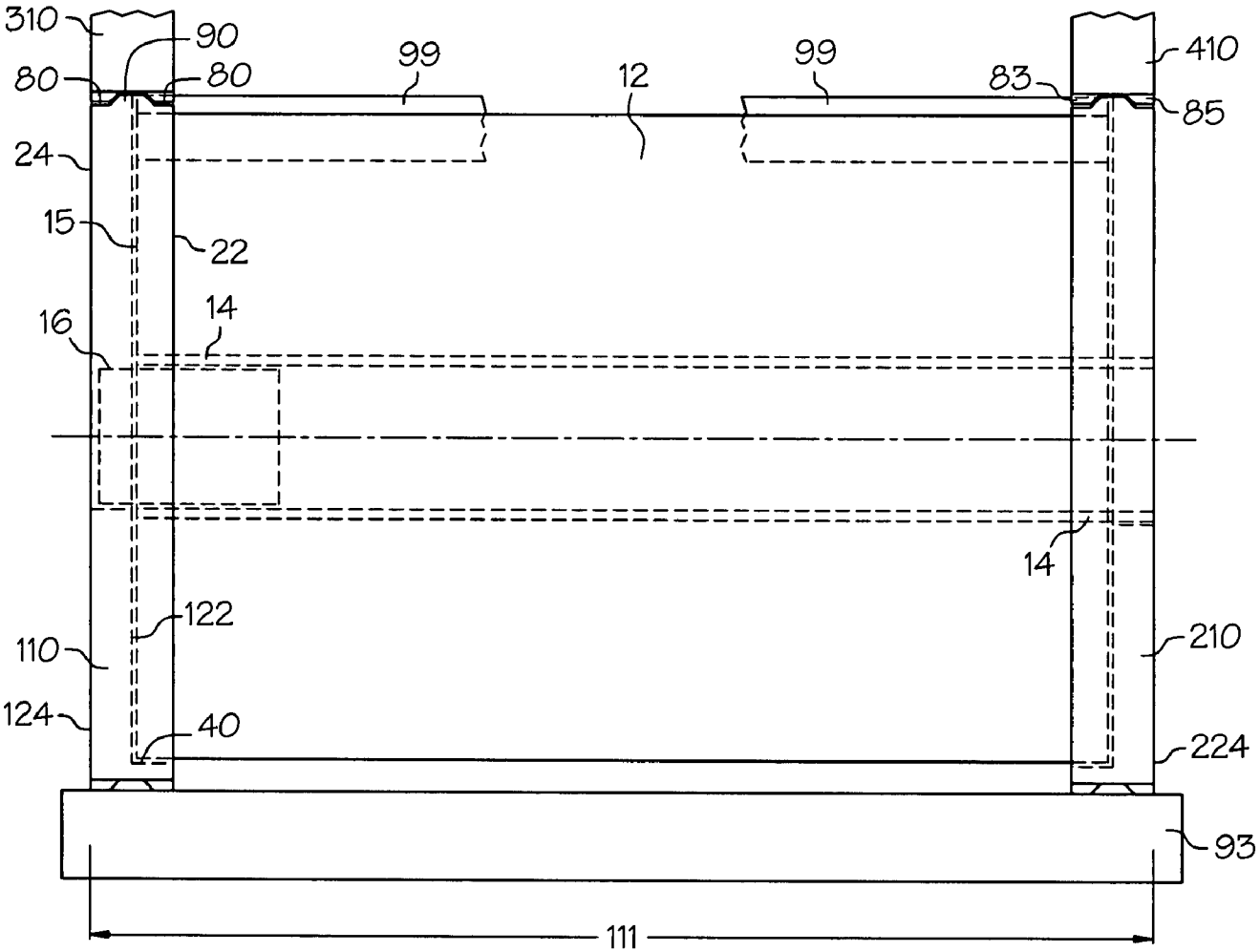
FIG. 5 is a side view illustration of a pair of end-boards according to the present invention supporting a core-wound roll product using core-plugs and further illustrating stacking of end-boards.

Referring to FIG. 5, the core support aperture 30 may support a core plug 16 or a core 14 therein. FIG. 5 illustrates use of either a core plug 16 or an extended core 14 for supporting a product roll 12. An end-board 110 on the left side of the assembly is illustrated supporting a core plug 16 within the core support aperture 30, while the end-board 210 on the right side of the assembly is illustrated supporting a core 14 that extends beyond the end-face 15 of the roll 12.

The term "support", as used herein may be defined broadly to encompass bearing the weight or load from a core-wound roll 12 positioned within a core support aperture 30, and also to locate or position the core-wound roll 12 with respect to the support plate 20.

Figure 2:
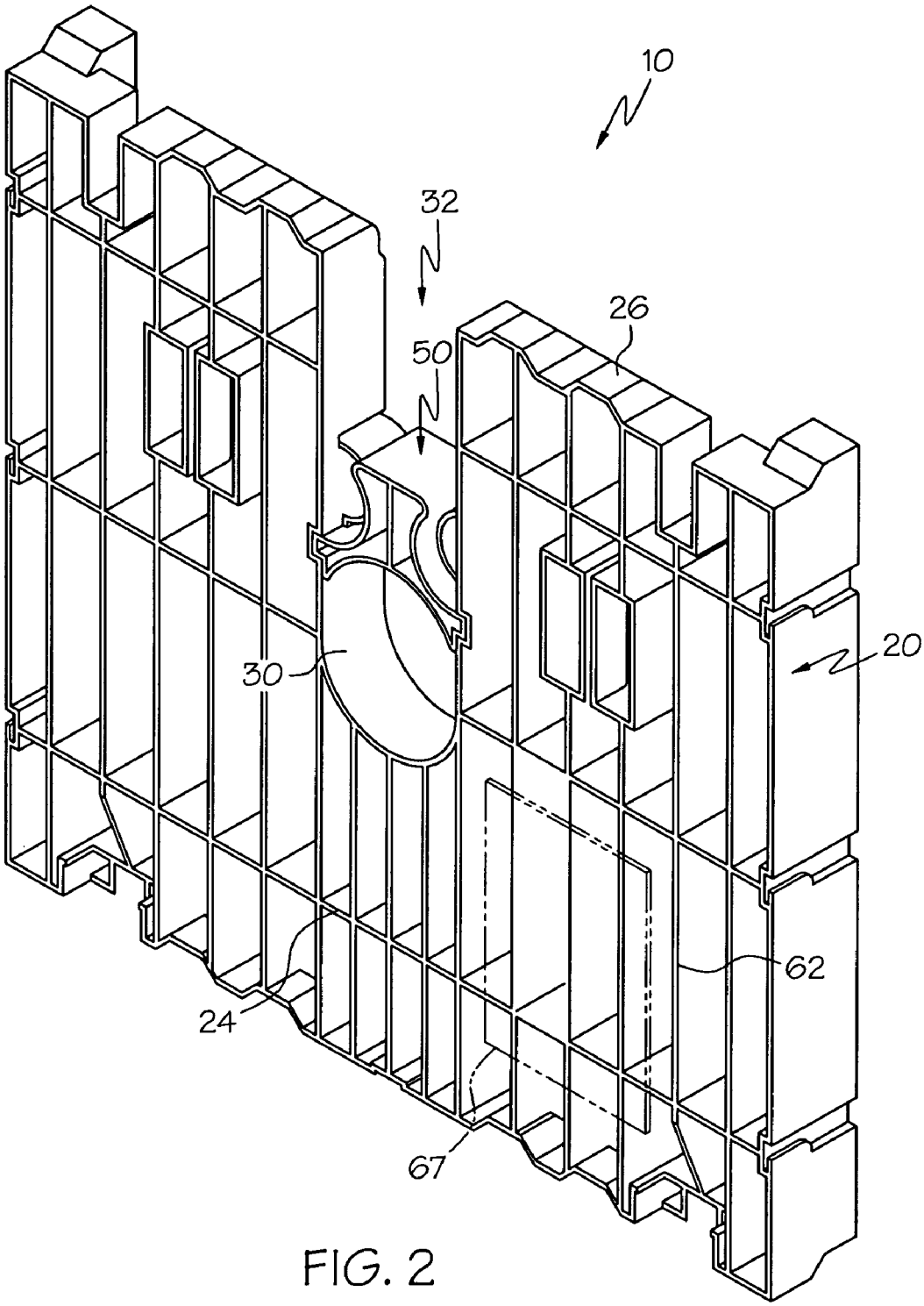
FIG. 2 is an orthogonal illustration of an end-board according to the present invention, with a view of the outer face of the end-board.
Figure 4:
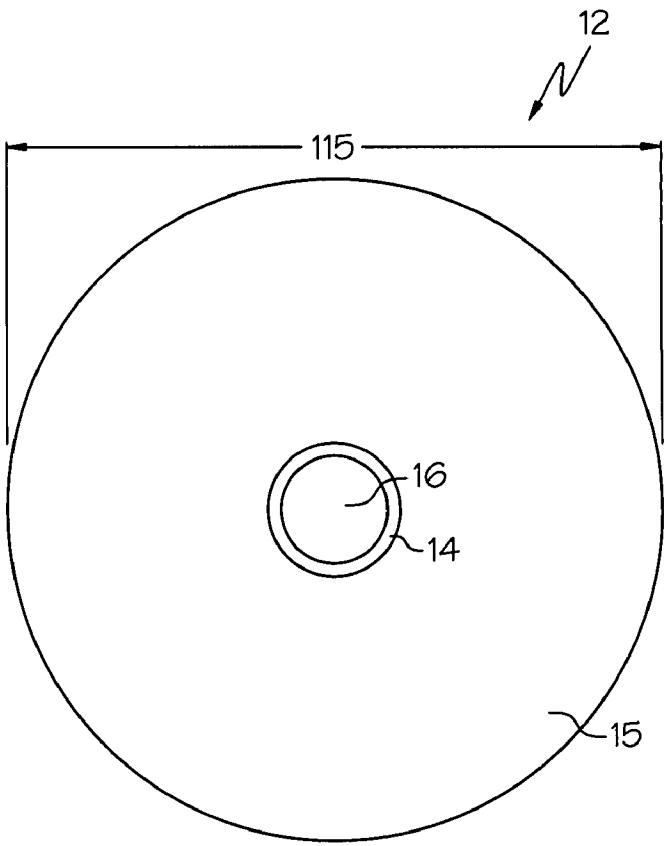
FIG. 4 illustrates an end-view of a core-wound roll product.
Figure 3:
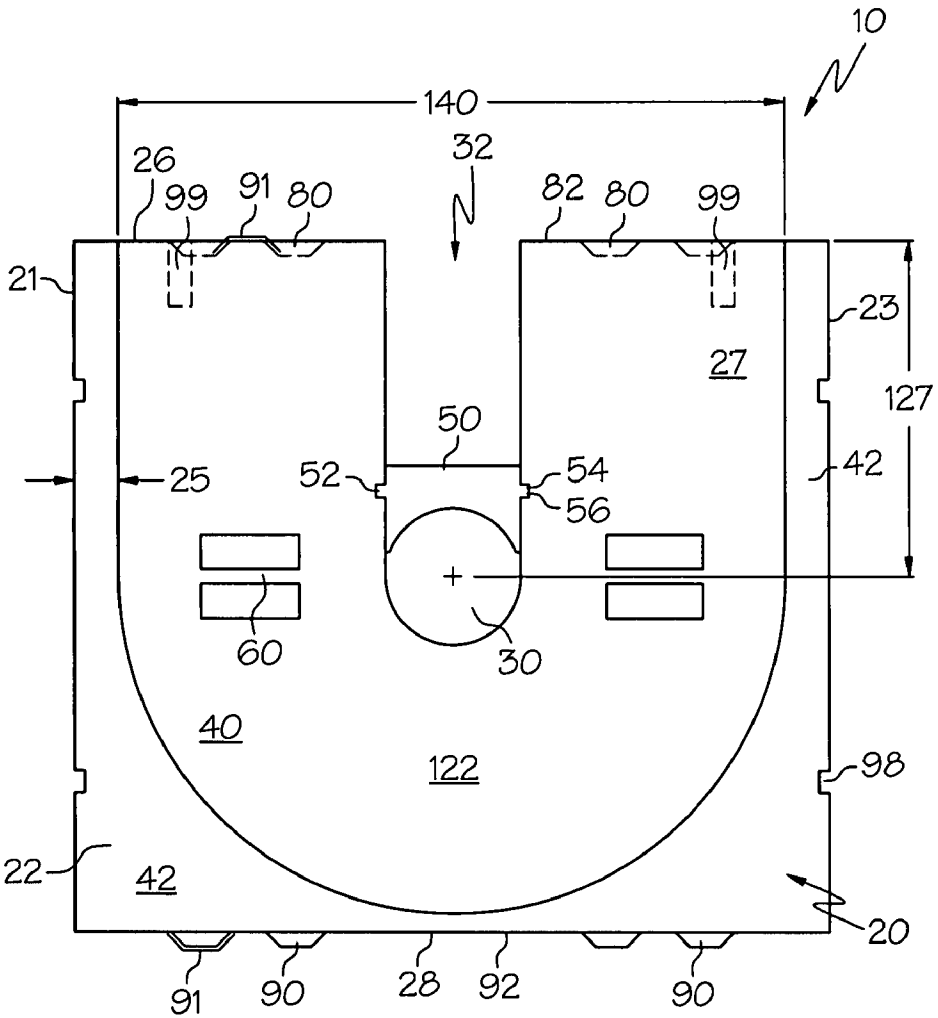
FIG. 3 illustrates the product face side of an end-board according to the present invention.

The support plate 20 also comprises a roll recess 40 for receiving an end 15 of the core-wound roll 12 within the roll recess 40, as illustrated in FIG. 5, when the core plug 16 or the core 14 is positioned in the core support aperture 30. The product face 22 comprises a substantially non-recessed portion 42 and a recessed portion 40, the recessed portion 40 of the product face 22 forming a roll recess 40. Referring to FIG. 3, the roll recess 40 is preferably circular in shape, preferably with a diameter 140 slightly larger than the cross-sectional diameter 115 of a supported roll 12. The roll recess 40 also more preferably further comprises a channel recess portion 27 along length 127 to interconnect the circular recessed portion of the roll recess 40 with the top surface 26. The channel recess 27 preferably comprises parallel sides tangentially intersecting the outer diameter 140 of the circular portion of the roll recess 40, such that the roll recess 40 forms a generally U-shaped recess 40, as illustrated in FIGS. 1, 2 and 3. Preferably, the U-shaped roll recess 40 has a roll recess diameter 140 substantially equal to or greater than a cross-sectional diameter 115 of the core-wound roll product 12.

Figure 6:
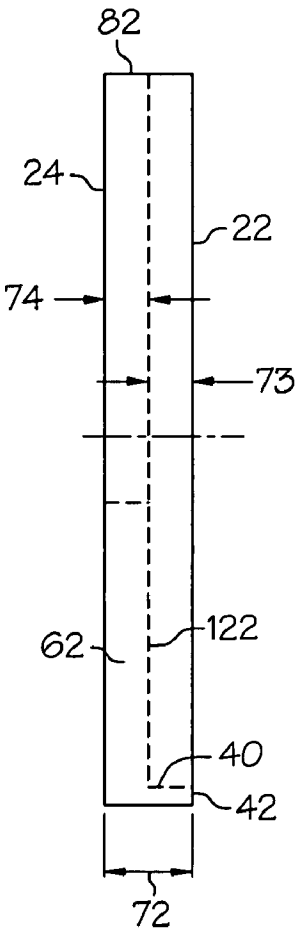
FIG. 6 is a side view of the end-board illustrated in FIG. 3, further illustrating the relative positions of various planes or surfaces of certain features.

Referring to FIG. 6, the core recess 40 preferably comprises a recessed depth 73 of at least one-half of the maximum distance 72 between the non-recessed portion 42 of the product face 22 and the outer face 24.

For purposes of this invention, the maximum distance 72 between the plane of the non-recessed portion 42 of the product face 22 and the plane of the outer face 24 may be referred to as the side width or thickness 72 of the end-board 10. The depth of the roll recess 40 from the plane of the non-recessed portion 42 of the product face 22 may, however, be substantially larger than one-half of thickness 72, such that the end-plate substantially overlaps the end portion of the roll product 12.

An advantage of end-boards according to the present invention is that the plane of the non-recessed portion 42 of the product face 22, the plane of the recessed portion 40 of the product face 22 and the plane of the outer surface 24 are all substantially parallel, with no stabilizing feet protruding laterally from the product face 22. The maximum width 72 of the top surface 26 and of the sides 21 and 23 near the top surface of the support plate 20 are substantially equal to the maximum width 72 of the base surface 28 and of the sides 21 and 23 near the base surface 28.

An objective of this invention is to provide a lightweight, durable, polymeric end-board that does not increase the overall distance 111, as illustrated in FIG. 5, between the outer surface 124 of a first end-board 110 and the outer surface 224 of a second end-board 210, as compared to an analogous distance in a prior art wood or MDF end-board system. It is also preferred to have the long dimension of base 28, top 26, and sides 21 and 23 of the end-board 10 substantially the same dimensional length as each respective component on prior art wood or MDF end-boards. Further, referring to FIG. 3, the distance 25 between the side of the channel recess 27 and support plate side 21 or side 23, is preferably no greater than the substantially analogous distance between the outer edge of a roll 12 and an end-board side 21 or 23 on prior art end-boards.

Enhanced end-board strength may be desirable to accommodate multiple-roll vertical stacks or for transporting or manipulating exceptionally large or heavy rolls 12. To provide enhanced strength, durability and stability as compared to prior art end-boards, or to minimize wall thickness 74, it is possible with the present invention to enhance the maximum distance 72 and the product overlap by the sides 21 and 23, without increasing roll assembly width 111. Maximum distance 72 of sides 21 and 23 may be substantially larger than the distance or wall thickness 74 between the recessed portion 40 of the product face 22 and the outer surface 24. The width 72 of the non-recessed portion of the support plate 20 is preferably at least 20% greater than the wall thickness 74 of the recessed portion 74. More preferably, the width 72 is at least 50% greater than wall thickness 74, and even more preferably, width 72 is at least 100% greater than the wall thickness 74 of the recessed portion 40. For example, a polymeric end-board may comprise a width 72 of four inches and a wall thickness 74 of substantially one-and-one-half inches. The difference in width 72 and thickness 74 may depend upon consideration of a number of factors, including the required structural integrity, required lateral stability, load-bearing requirements, material type, and structural design of the support plate 20.

It is a feature of end-boards 10 according to the present invention that regardless of the selected size of side width 72 or recess depth 73, a core-wound roll 12 may be moved vertically up or down through the channel recess 27 without requiring lateral removal of the end-board 10 away from the adjacent end 15 of the core-wound roll 12. In a preferred embodiment, side width 72 is sufficiently large such that the end-board 10 may be easily free-standing and laterally stable when not engaged with a roll 12 or core plug 16. Thereby, a roll 12 may be moved vertically in or out of the end-board roll recess 40 without knocking the end-board 10 over or requiring lateral removal of the end-board 10.

The support plate 20 also preferably comprises a core channel 32 to interconnect the core support aperture 30 with the top surface 26. A core plug 16 or core 14 may be supported or positioned within the core support aperture 30. Preferably, the load bearing supporting portion of core support aperture 30 is semicircular in shape to conform to the shape and size of the supported core 14 or core plug 16. Preferably the core channel 32 comprises substantially parallel, vertical sides separated by a distance substantially equal to or slightly greater than the diameter of a core 14 or core plug 16. The core channel 32 thus permits optionally, vertically passing a core 14 or core plug 16 through the core channel 32 to engage or disengage a support plate 20 and a roll 12.

A preferred embodiment of an end-board 10 may also comprise a locking collar 50, selectively engageable with the support plate 20, within the support plate core channel 32. The locking collar 50 may prevent the supported core plug 16 or the core 14 from passing vertically through the core channel 32 when the locking collar 50 is mechanically engaged with the support plate 20.

Core channel 32 and locking collar 50 facilitate selectively engaging or disengaging an end-board 10 and roll 12 either laterally or vertically. Thereby, a core 12 may be supported on a pair of end-boards 10 and removed from the end-board without requiring manual intervention to laterally disengage the end-boards from the roll 12. Mechanical engagement of the locking collar 50 and support plate 20 provides means for securing the end-plate 10 with the roll 12.

Mechanical engagement of the locking collar 50 and support plate 20 may be effected by any of a number of mechanisms. The support plate 20 and locking collar 50 may comprise a collar connector 52 for effecting the mechanical engagement of the locking collar 50 and support plate 20. In one preferred embodiment, the collar connector 52 may comprise two mechanically interlocking components, such as a locking collar member 54 that is mechanically attached to or positioned within the locking collar 50, and a support plate locking member 56 that is mechanically attached to or positioned within the support plate 20 and is selectively engageable with the locking collar member 54. The two member components 54 and 56 of the collar connector 52 may comprise, for example, a slot member and an upset or key member. In such embodiment, the locking collar member 54 may comprise one or more key members and the support plate locking member 56 may comprise one or more slots, each for receiving and engaging a corresponding key member therein when the locking collar 50 is engaged with the support plate 20. To avoid having a key member protruding into the core channel 32, in such key and slot arrangement, it is preferable to provide the slot member in the core channel 32 as illustrated in FIGS. 1, 2, and 3.

FIGS. 1, 2, and 3 illustrate merely one embodiment or means for engaging a locking collar 50 with a support plate 20. Components of the locking collar 50 and support plate 20 may mechanically engage each other by friction fit, such as utilization of a tapered of angled components. Other locking collar and support plate embodiments may engage each other by other means, such as by die or tooth engagement, or by snapping components into a snap-fitted engagement. Still other embodiments may utilize pins or the like for securing the locking collar 50 within the core channel 32.

To optimize the balance between strength and lightweight properties, an end-board 10 according to the present invention may comprise a lattice 24 of support fins or ribs to provide structural strength to the support plate 20. The lattice arrangement 24 may comprise a network, truss, web or similar arrangement of fins or ribs. It is preferred that the support plate 20 and locking collar 50 both are manufactured or formed from a polymeric material.

Weight reduction is achieved through employment of the support lattice network 24. Weight reduction may also be facilitated through employment of a relatively low density material or high strength-to-weight ratio material, such as aluminum or polymeric materials.

To achieve the desired combination of weight reduction and strength, it is preferred to use a combination of a structurally engineered lattice arrangement in combination with use of a structurally suitable polymeric material. Such combinations can be utilized to produce an end-board that weighs approximately fifty percent (50%) less than a similar sized MDF end-board. Suitable polymeric materials include any of the known thermoplastics useful for injection molding, extruding, and roto-molding manufacturing processes, as any of such processes may be used for manufacturing such end-boards. For example, in one preferred embodiment, end-boards are manufactured from ABS polymeric material. Additional compounds may be added to the polymeric materials to improve end-board life and functionality, including anti-oxidants, UV stabilizers, fillers, and colorants. The end-boards should be structurally designed to safely accommodate the loads anticipated for their designed application. For example, each end-board for use with large rolls of polymeric film might be designed to safely support core-wound roll loads of up to 2000 kilograms (over 4000 pounds) per end-board.

All or a portion of the product face may also preferably comprise a substantially smooth, substantially planar, solid surface thereon, as illustrated by a portion of the product face 22 in FIG. 1. In addition to providing strength and stability, the substantially smooth portion of the product face may also protect the end 15 of the core-wound roll 12. It is preferable that the portion of the product face 22 that may engage the end 15 of the core-wound roll 12 when the core 14 is supported in the core aperture 30, is substantially planar. Thus, it is preferred that the end 15 of the roll 12 engages only a substantially smooth, planar surface.

The support plate 20 may also comprise at least one handle 60 and preferably a pair of handles 60, as illustrated in FIGS. 1, 2 and 3. The handle 60 may comprise an opening in the support plate 20 extending between the product face 22 and outer face 24 with a gripping member positioned within the slot for manually grasping. Such arrangement preferably avoids having a component of the support plate 20 extend perpendicularly beyond the plane of the outer face 24.

It may also be preferable for the handle opening to not extend all of the way through from the outer face 24 to the product face 22, but rather that the smooth portion 122 of the product face 22 cover the handle opening on the product face 24 of the support plate 20. Thereby, the handle opening is only accessible from the outer face 24 side of the support plate 20. Such design serves not only to further protect the end 15 of the roll 12, but also from a safety perspective such design serves to avoid any pinch-points with the end 15 of the core-wound roll, when manually grasping the handles.

To provide stability to a stacked arrangement of end-boards, as illustrated in FIG. 5, it is preferable to provide on the top surface 26 and base surface 28, an arrangement of offsets, recesses, or interlocking features. FIGS. 1, 2, 3, 5 and 6 illustrate interlocking lug arrangements on the end-boards. FIG. 3 illustrates a set of top interlock recesses 80 that are recessed in the top surface 26, the recesses being recessed relative to a top plane 82 of the top surface 26 that also comprises a non-recessed portion of the top surface 26. Similarly, the base surface 28 of the support plate 20 may comprise one or more corresponding base interlock lugs 90 that are raised-offset relative to a base plane 92 that comprises a non-raised portion of the base surface 28. In one preferred embodiment, each top interlock recess 80 will receive therein, a corresponding base interlock lug 90 from the adjacent, stacked end-board 10. Referring to FIG. 5, the top interlock recess 80 of each of a first end-board 110 and second, opposing end-board 210 receives therein a corresponding base interlock lug 90 of a first stacked end-board 310 and a second stacked end-board 410 that are vertically engaged with the respective first 110 and second 210 end-boards. The dimensions, shape, and arrangement of the lugs 90 and recesses 80 should limit movement of a stacked end-board to become displaced during transport.

It will be apparent to one skilled in the art that the relative positions of the lugs 90 and recesses 80 may be interchanged between the top surface 26 and base surface 28. FIG. 1 illustrates an embodiment whereby the lugs 90 are provided on the top surface 26 and the recesses 80 are provided in the base 28.

To promote enhanced lateral adhesion between a set of stacked end-boards and/or between an end-board and another surface, such as a wood pallet 93, it may be desirable on some embodiments to provide one or more cleats 91, as illustrated in FIG. 3. The cleats 91 may be fixedly engaged with either an interlocking lug 90 or the recesses of an interlock recess 80. The cleats may preferably be formed from stamped metal having an impressed tooth pattern on the outer or convex side of a substantially "cap-shaped" cleat member 91.

To provide an end-board compatible for use with certain prior art end-boards that utilize elongate cross-members extending between a first end board, such as end-board 110, as illustrated in FIG. 5, and a second end-board such as end-board 210, it may be desirable to provide at least two cross-member slots 94 within the top surface 26 of each support plate 20. Each cross member slot 94 may open at the top surface 26 of the support plate 20 for supporting therein, an elongate cross member, such as a two-by-four piece of lumber.

The end-board 10 may further comprise at least one strapping notch 98 disposed on each of the support plate first side 21 and the support plate second side 23. Thereby, a pair of opposing end-boards supporting a roll 12 may be mechanically secured to the roll with strapping material, if so desired.

End-boards according to the present invention may also comprise a labeling placard 67 for securing thereto a label, such as a product label, and/or a surface for writing or securing thereto documentation containing roll product information. The placard 67 may comprise a writing surface, a mounting surface, or a pocket having a transparent outer cover for displaying the label contents therein. Referring to FIG. 5, this invention also comprises a packaging system utilizing end-boards according to the present invention. The term "packaging system" is defined broadly to include systems for storage, shipping, protecting, or otherwise manipulating a core-wound roll product 12. Such packaging system may utilize one pair of opposing end-boards, 110 and 210, supporting a single roll of core-wound roll product 12. Other embodiments of a packaging system according to the present invention may additionally comprise third 310 and fourth 410 end-boards stacked vertically upon first 110 and second 210 end-boards respectively, and supporting a second roll with the third 310 and fourth 410 end-boards. Still other packaging system embodiments may comprise either one pair 110, 210 of end-boards according to this invention supporting a single roll and/or a stacked end-board system, including end-boards 310 and 410 therewith, supported upon a wood pallet 93, dolly, or similar platform, as illustrated in FIG. 5. It is an advantage of end-boards according to this invention that such system does not increase the width 111 between opposing end-boards as compared to wooden or MDF end-boards and provides stability without requiring use of elongate support members 99, illustrated in FIG. 5, to support a stacked assembly.

It will be recognized by those skilled in the art that various changes to the components or methods herein, as well as in the details of the illustrated apparatus and systems, may be made within the scope of the attached claims without departing from the spirit of the invention. While preferred and alternative embodiments of the present invention are described and illustrated in detail, it will be apparent that still further modifications and adaptations of the preferred embodiments will occur to those skilled in the art. However, it is to be expressly understood that such modifications and adaptations are within the spirit and scope of the present invention.

What is claimed is:

1. An end-board for supporting a core-wound roll, comprising:

a support plate having a top surface, a base surface, a first side, a second side, a product face, an outer face, a core support aperture, a core channel connecting the core support aperture with the top surface, the top surface being discontinuous across the core channel, the core support aperture for supporting a core plug or a core therein, the product face having a roll recess in the product face for receiving an end of the core-wound roll within at least a portion of the roll recess when the core plug or the core is positioned in the core support aperture, the roll recess further including a channel recess portion to interconnect the roll recess with the top surface.

2. The end-board as defined in claim 1, further comprising:

a locking collar selectively engageable with the support plate in the support plate core channel to prevent the core plug or the core from passing through the core channel when the locking collar is engaged with the support plate.

3. The end-board as defined in claim 2, further comprising:

a collar connector for connecting the locking collar with the support plate.

4. The end-board as defined in claim 3, wherein the collar connector comprises:

a locking collar member attached to or positioned within the locking collar; and a support plate locking member attached to or positioned within the support plate and selectively engagable with the locking collar member.

5. The end-board as defined in claim 4, wherein the locking collar member comprises a key and the support plate locking member comprises a slot for receiving the key when the locking collar is engaged with the support plate.

6. The end-board as defined in claim 1, wherein the support plate further comprises:

at least one handle engaged with the support plate and accessible from the outer face of the support plate when the support plate is supporting a core or a core plug in the core support aperture.

7. The end-board as defined in claim 1, wherein the roll recess is substantially circular in shape, the roll recess having a roll recess diameter substantially equal to or greater than a cross-sectional diameter of the core-wound roll product.

8. The end-board as defined in claim 7, wherein the roll recess further comprises:

a channel recess for passing the end portion of the core-wound roll product through the channel recess when the core is passed trough the core channel, the channel recess interconnecting the top surface with the roll recess.

9. The end-board as defined in claim 1, wherein the roll recess is substantially U-shaped, the roll recess having a roll recess diameter substantially equal to or greater than a cross-sectional diameter of the core-wound roll product.

10. The end-board as defined in claim 1, wherein the support plate further comprises an arrangement of support ribs to structurally strengthen the support plate.

11. The end-board as defined in claim 1, wherein the maximum width of the top surface between the outer face and the non-recessed portion of the product face is substantially equal to the maximum width of the base surface between the outer face and the non-recessed portion of the product face.

12. The end-board as defined in claim 1, wherein the top surface comprises:

at least one interlock recess that is offset relative to a top plane that comprises a non-offset portion of top surface.

13. The end-board as defined in claim 12, wherein the interlock recess comprises at least a first interlock recess and a second interlock recess and wherein the first interlock recess recesses into the product face and not the outer face and the second interlock recess recesses into the outer face and not the product face.

14. The end-board as defined in claim 1, wherein the top surface comprises:

at least one interlock lug that is offset relative to a top plane that comprises a non-offset portion of the top surface.

15. The end-board as defined in claim 1, wherein the recessed portion of the product face is substantially planar.

16. The end-board as defined in claim 1, wherein at least one of the top surface and the base surface further comprises:

at least one cleat for engaging at least one of an adjacent wood pallet and an adjacent end-board.

17. The end-board as defined in claim 1, wherein the support plate further comprises:

at least one cross-member slot, each cross member slot open at the top surface of the support plate and each cross member slot for supporting an elongate cross member therein.

18. The end-board as defined in claim 1, wherein each of the support plate product face and the support plate outer face are substantially planar and substantially parallel.

19. The end-board as defined in claim 1, further comprising at least one strapping notch disposed on each of the support plate first side and the support plate second side.

20. The end-board as defined in claim 1, wherein the outer face further comprises a labeling placard for securing thereto a label containing roll product information.

21. The end-board as defined in claim 1, wherein the maximum width between the outer face and the non-recessed portion of the product face is at least 20 percent greater than the wall thickness between the outer face and the recessed portion of the product face.

22. The end-board as defined in claim 1, wherein the maximum width between the outer face and the non-recessed portion of the product face is at least 100 percent greater than the wall thickness between the outer face and the recessed portion of the product face.

23. The end-board as defined in claim 1, wherein the support plate is formed from a polymeric material.

24. An end-board for supporting a core-wound roll, comprising:

a) a support plate comprising a top surface, a base surface, a first side, a second side, a product face, an outer face, a core support aperture, and a care channel connecting the core support aperture with the top surface, the top surface being discontinuous across the core channel;

b) a locking collar selectively engaged with the support plate in the core channel to prevent a core or a core plug from passing through the core channel when the locking collar is engaged with the support plate;

c) a locking collar member attached to the locking collar;

d) a support plate locking member attached to the support plate and selectively engagable with the locking collar member; and e) at least one handle engaged with the support plate.

25. A system for packaging a core-wound roll, comprising:

a) a first end-board comprising i) a first support plate positioned vertically upright and substantially adjacent a first end of the core-wound roll product and supporting within the core support aperture a first end of a core or a core plug supporting the core-wound roll product;

ii) a first locking collar selectively engaged with the first support plate in the core channel of the first support plate; and b) a second end-board comprising i) a second support plate positioned vertically upright and substantially adjacent a second end of the core-wound roll product and opposing the first end-board, the second end-board supporting within the core support aperture a second end of a core or a core plug supporting the core-wound roll product;

ii) a second locking collar selectively engaged with the second support plate in the core channel of the second support plate.

26. The packaging system of claim 25, further comprising:

a) a third end-board comprising i) a third support plate positioned vertically upright and substantially adjacent a first end of a second core-wound roll product and supporting within the core support aperture a first end of a core or a core plug supporting the second core-wound roll product;

ii) a third locking collar selectively engaged with the third support plate in the core channel of the third support plate;

the base surface of the third end plate supported upon the top surface of the first end plate; and b) a fourth end-board comprising i) a fourth support plate positioned vertically upright and substantially adjacent a second end of the second core-wound roll product and supporting within the core support aperture a second end of a core or a core plug supporting the second core-wound roll product;

ii) a fourth locking collar selectively engaged with the fourth support plate in the core channel of the fourth support plate; and the base surface of the fourth end plate supported upon the top surface of the second end plate.

* * * * *